United States Patent [19]

Ibuki et al.

[11] 4,228,332

[45] Oct. 14, 1980

[54] GAS PRESSURE CIRCUIT INTERRUPTER

[75] Inventors: Koji Ibuki; Yoshihiro Ueda; Masami Kii, all of Amagasaki, Japan

[73] Assignee: Mitsubishi Denki Kabushiki Kaisha, Tokyo, Japan

[21] Appl. No.: 889,878

[22] Filed: Mar. 24, 1978

[30] Foreign Application Priority Data

Mar. 24, 1977 [JP] Japan ..... 52/32916

[51] Int. Cl.[2] ..... H01H 33/64

[52] U.S. Cl. ..... 200/148 R; 200/148 B

[58] Field of Search ..... 200/148 R, 148 A, 148 B, 200/148 C, 148 D, 148 E, 148 F, 148 G, 148 H, 148 J, 148 BV

[56] References Cited

U.S. PATENT DOCUMENTS

| | | | |
|---|---|---|---|
| 4,032,736 | 6/1977 | Ruffieux et al. | 200/148 B X |
| 4,139,752 | 2/1979 | Itai et al. | 200/148 R X |

OTHER PUBLICATIONS

Japanese Utility Model Publication No. 29345/1972, to Iwamoto et al.

Japanese Utility Model Publication No. 42465/1974, to Iwamoto et al.

*Primary Examiner*—J. V. Truhe

*Assistant Examiner*—Morris Ginsburg

*Attorney, Agent, or Firm*—Oblon, Fisher, Spivak, McClelland & Maier

[57] ABSTRACT

A circuit interrupter comprises a pair of contacts in a container filled with a gas for extinction; an insulation nozzle around the contacts to form an arc chamber; a gas chamber which is connected to the arc chamber under departing the contacts. The gas pressure in the arc chamber and the gas chamber is increased by the energy of the arc generated at the departing the contacts. When the arc current is large, the flow-out of the gas from the arc chamber and the gas chamber is decreased by the arc whereas the high pressure gas in the arc chamber and the gas chamber is discharged through the insulation nozzle into the container at the time decreasing the arc current near zero whereby the arc is interrupted by the gas flow discharged.

5 Claims, 8 Drawing Figures

GAS PRESSURE CIRCUIT INTERRUPTER

BACKGROUND OF THE INVENTION

1. FIELD OF THE INVENTION

The present invention relates to a circuit interrupter in which an extinction of arc formed between contacts is carried out by puffing a gas for extinction.

2. DESCRIPTION OF THE PRIOR ART

When a gas having high extinction property such as $SF_6$ is used in a circuit interrupter, it has been usual that certain gas pressure difference is caused by certain manner and the gas is puffed to the arc to result in the extinction of the arc whereby the current is interrupted.

Two manners have been proposed for forming the gas pressure difference. One is a double pressure system wherein the gas such as $SF_6$ is charged at suitable pressure in a closed container and the gas pressure difference is given by forming high pressure by a separate gas pressure generator and the gas is puffed by opening a valve disposed between the higher pressure zone and the lower pressure zone at the interrupting time under interlocking to the interrupting operation whereby the extinction of the arc is attained. In the first system the gas pressure generator for generating and maintaining the high pressure gas and the structure for separating two pressure systems having higher pressure and lower pressure are complicated and large size so as to be uneconomical. Accordingly, it has been difficult to use it in practice from the viewpoint of the maintenance for maintaining the high gas pressure in the normal condition.

The other conventional system for forming the gas pressure difference is the single pressure type puffer system wherein a puffer device is operated in the gas space having several atm. charged in a closed container under interlocking to the interrupting operation and the resulting high pressure gas is puffed to the arc to interrupt the arc.

In the second system, the compressed gas having several atm. which is lower than that of the double pressure system, is charged, whereby the structure of the container is simple. However, the puffer device interlocking to the interrupting operation as the mechanical pressure generator is needed. The driving force for the puffer device is remarkably increased depending upon increasing the interrupting current and increasing the input power. Accordingly, in a large capacity type circuit interrupter, a driving device having high force is needed.

As a compensation means, an electromagnetic driving type puffer device has been proposed. However, they have disadvantages of large size, complicated structure and uneconomical and accordingly, it has been difficult to use in practice.

SUMMARY OF THE INVENTION

The present invention provides a circuit interrupter having economical and simple structure which comprises a pair of contacts in a container filled with a gas for extinction; an insulation nozzle disposed around the contacts to form an arc chamber and a gas chamber which is connected to the arc chamber during the time departing the contacts whereby the flow of the gas from the insulation nozzle is controlled by the arc and the circuit interrupting operation can be attained without a gas compressor or the other compressing device.

The gas chamber connected to the arc chamber is not limited to one chamber but to be plural chambers whereby the effect can be increased by the mutual action of the plural chambers.

BRIEF DESCRIPTION OF THE DRAWINGS

FIG. 1 shows the current passing condition of the circuit interrupter;

FIG. 2 shows the condition starting the circuit interrupting operation;

FIG. 3 shows the condition just before finishing the circuit interrupting operation;

FIG. 4 shows the current passing condition;

FIG. 5 shows the condition just before finishing the circuit interrupting operation;

FIG. 6 shows the current passing condition;

FIG. 7 shows the condition just before finishing the circuit interrupting operation.

DETAILED DESCRIPTION OF THE PREFERRED EMBODIMENTS

Figure 1:
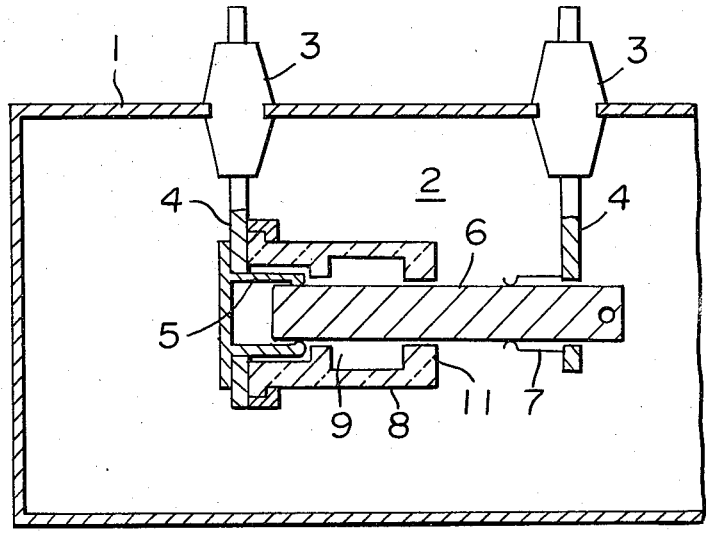
FIGS. 1 to 3 respectively show sectional views of one embodiment of the circuit interrupter according to the present invention.
Figure 2:
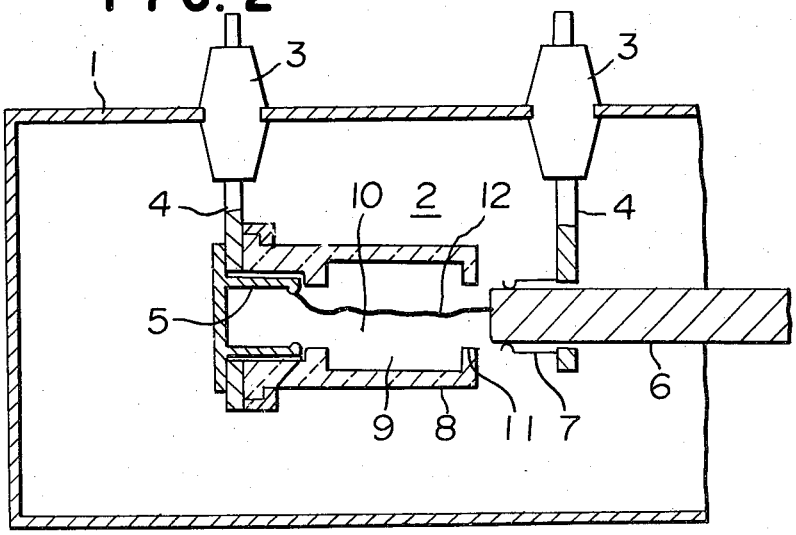
Figure 3:
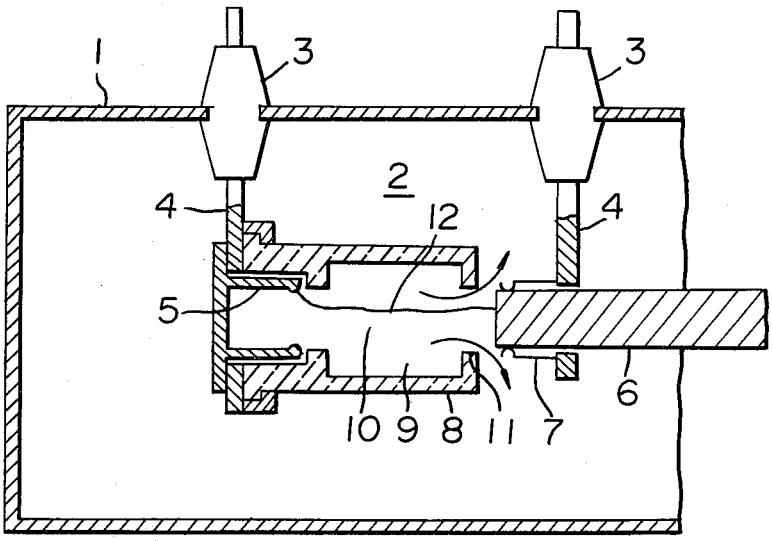

Referring to FIGS. 1, 2 and 3, one embodiment of the present invention will be illustrated.

FIG. 1 shows the condition passing current by contacting the contacts in the circuit interrupter; FIG. 2 shows the condition forming the arc in the circuit interrupting operation and FIG. 3 shows the condition decreasing the arc current near zero at the time just before finishing the circuit interrupting operation.

As shown in the drawings, an interrupting part (2) is disposed in a container (1) filled with the gas for extinction. A conductor (4) held by a bushing (3) which is mounted on the container (1) and a cup type fixed contact (5) is connected and the opening end of the fixed contact (5) is contacted with a cylindrical movable contact (6) to pass the current. The movable contact (6) is electrically connected through a current collector (7) to the other conductor (4). An insulation nozzle (8) is disposed around the movable contact and the fixed contact and the nozzle (8) has a hollow (9) which forms the gas chamber connected to the arc chamber shown in FIG. 2.

The operation of the circuit interrupter will be illustrated.

In the condition contacting the contacts shown in FIG. 1, the movable contact (6) is departed from the fixed contact (5) by moving the movable contact by an operation mechanism (not shown) to the right direction, whereby the arc (12) is formed between the contacts. The condition is shown in FIG. 2. The gas in the arc chamber (10) is heated by the arc (12) to increase the pressure. Even though the movable contact (6) is moved out of the outlet (11) of the insulation nozzle (8) to connect the arc chamber (10) to the container (1), the flow of the gas from the arc chamber (10) is controlled by the arc (12) during the time of large arc current whereby the pressure in the arc chamber (10) is not highly decreased. However, when the arc current decreases near zero, the diameter of the arc (12) is decreased as shown in FIG. 3 whereby the pressure in the arc chamber (10) is released and the gas is rapidly discharged through the outlet (11) of the insulation nozzle (8) into the container (1), and the arc is immediately cooled to be interrupted.

As described above, the circuit interruption can be attained without a special gas puffing device, because the flow of the gas from the arc chamber (10) is controlled by the arc (12) itself under selecting the size of the arc chamber and the arc is immediately cooled at the time decreasing the arc current near zero.

Figure 4:
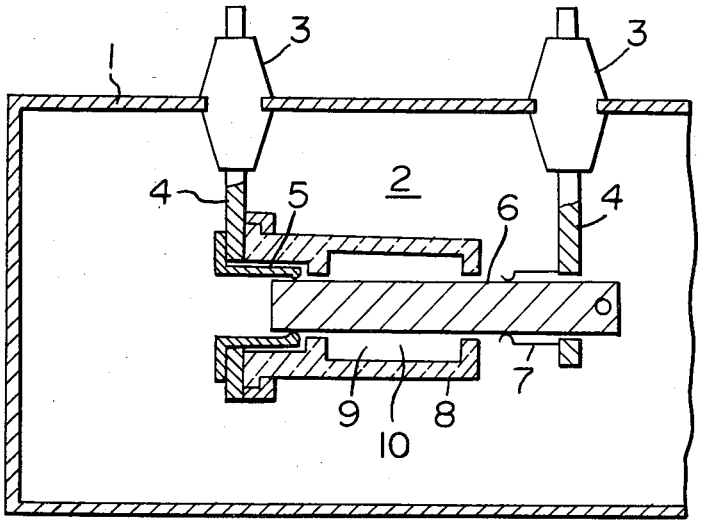
FIGS. 4 and 5 are respectively the partially enlarged sectional views of the other embodiment of the circuit interrupter according to the present invention.
Figure 5:
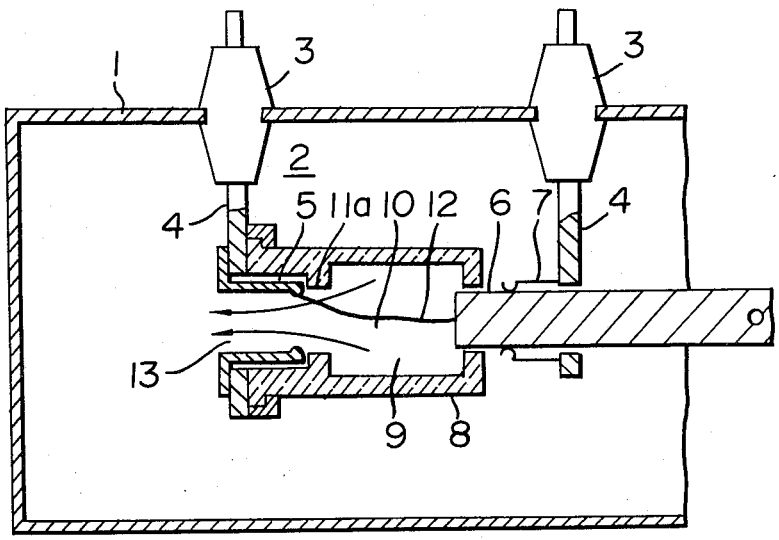

Referring to FIGS. 4 and 5, the other embodiment of the present invention will be illustrated.

FIG. 4 shows the condition contacting the contacts and passing the current in the circuit interrupter. The pipe type fixed contact (5) is connected to the one opening end of the cylindrical movable contact (6). As the same with the former embodiment, the movable contact (6) is moved to the right direction to perform the circuit interrupting operation.

As the same with the former embodiment, the hollow (9) is formed in the insulation nozzle (8) to form the gas chamber connected to the arc chamber (10). The arc formed between the contacts (5), (6) controls the flow of the gas from the outlet (11*a*) of the insulation nozzle (8) and the other opening end of the fixed contact, whereby the gas pressure in the arc chamber (10) is increased. When the arc current decreases near zero, the diameter of the arc (12) is suddenly decreased to release the pressure in the arc chamber (10) and the arc is immediately cooled to attain the circuit interruption.

Figure 6:
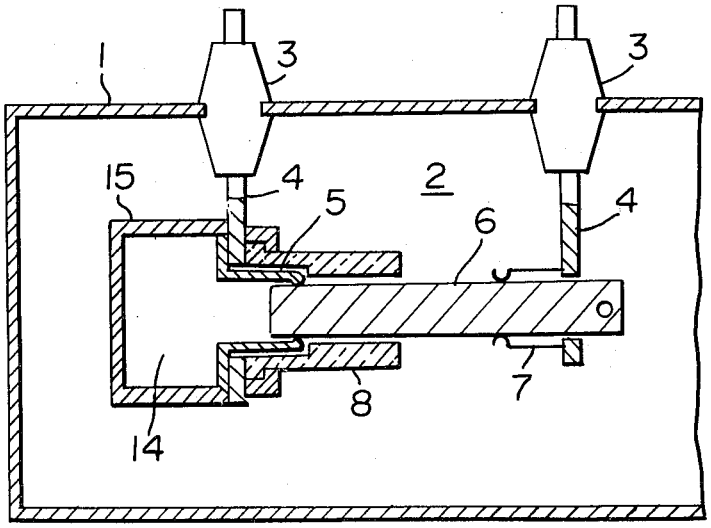
FIGS. 6 and 7 are respectively the partially enlarged sectional views of the other embodiment of the circuit interrupter according to the present invention.
Figure 7:
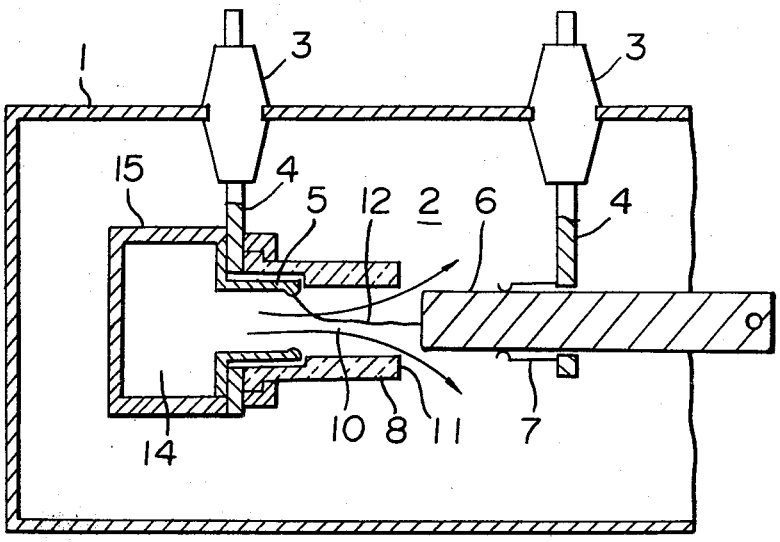

Referring to FIGS. 6 and 7, the other embodiment of the present invention will be illustrated.

The operation is the same with that of the former embodiment. However, the gas chamber (14) connected to the arc chamber (10) is formed at the left opening end of the pipe type fixed contact (5).

In the embodiment, the container (15) forming the gas chamber (14) is made of a metal and accordingly, the gas heated by the arc is cooled and excessive pressure increase and excessive temperature rising can be controlled as the additional effects.

FIG. 6 shows the condition contacting the contacts and passing the current and FIG. 7 shows the condition just before zero of the arc current in the circuit interrupting operation.

In these embodiments, all of the interrupting part (2) is disposed in the container (1).

Figure 8:
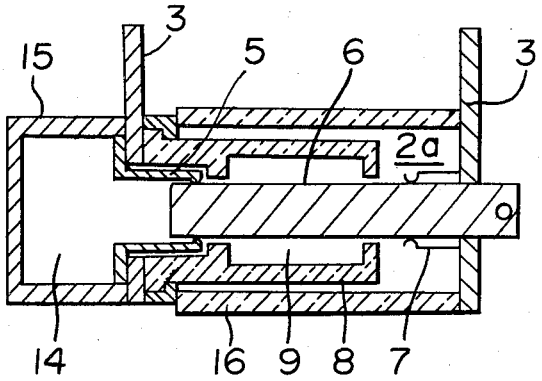
FIG. 8 is the partially enlarged sectional view of the other embodiment of the circuit interrupter according to the present invention.

Thus, it is possible to dispose the gas chamber (14) out of the insulation container (16) under the atmospheric pressure as shown in FIG. 8.

The main part (2*a*) of the interrupting part (2) is disposed in the insulation container filled with the gas for extinction. The gas chamber is formed with the hollow (9) of the insulation nozzle (8) and the gas chamber (14) connected to the fixed contact (5). The gas chamber of the hollow (9) is formed by the pipe type fixed contact (5), the cylindrical movable contact (6) and the insulation nozzle (8) and is connected to the arc chamber.

What is claimed as new and desired to be secured by letters patent of the United States is:

1. A circuit interrupter comprising:
a container filled with a gas for extinction;
a fixed contact in said container;
a movable contact normally connected to said fixed contact;
an insulation nozzle disposed around said contacts, said insulation nozzle including an enlarged portion which forms a unitary coextensive arc chamber and gas chamber; and
means for moving said movable contact to destroy said connection between said fixed and movable contacts,
whereby an arc is formed and the cool gas in said gas chamber easily mixes with and cools the hot gas in said arc chamber so that said arc may be easily extinguished.

2. The circuit interrupter of claim 1, wherein said fixed contact is a cup type contact having a closed end and said movable contact is adapted to be received within the cup during the connection of said contacts, and wherein said gas is discharged in the direction of movement of said movable contact.

3. The circuit interrupter of claim 1, wherein said fixed contact is a pipe type contact having one end open to said container and the other end enclosed by said nozzle and wherein said movable contact is adapted to be received within said other end and wherein said gas is discharged to said container through said one end.

4. A circuit interrupter comprising:
a container filled with gas for extinction;
a fixed contact in said container, said fixed contact being a pipe type contact having both ends open;
an insulation nozzle disposed around one end of said fixed contact and defining an arc chamber;
a gas chamber connected to the other of said ends of said fixed contact, said gas chamber communicating with said arc chamber only through said nozzle;
a movable contact extending through said insulation nozzle and adapted to be received within said one end; and
means to move said movable contact out of connection with said fixed contact whereby an arc is formed in said arc chamber, the flow of gas from said gas chamber to said arc chamber being prevented by said arc when the arc current is large.

5. The circuit interrupter of claim 4, wherein said gas chamber is not located in said container.

* * * * *